US010423175B2

(12) United States Patent
Chang et al.

(10) Patent No.: US 10,423,175 B2
(45) Date of Patent: Sep. 24, 2019

(54) METHOD FOR PROVIDING A VOLTAGE REFERENCE AT A PRESENT OPERATING TEMPERATURE IN A CIRCUIT

(71) Applicant: NANYANG TECHNOLOGICAL UNIVERSITY, Singapore (SG)

(72) Inventors: Joseph Sylvester Chang, Singapore (SG); Wei Shu, Singapore (SG); Jize Jiang, Singapore (SG)

(73) Assignee: NANYANG TECHNOLOGICAL UNIVERSITY, Singapore (SG)

( * ) Notice: Subject to any disclaimer, the term of this patent is extended or adjusted under 35 U.S.C. 154(b) by 0 days.

(21) Appl. No.: 15/328,300

(22) PCT Filed: Jul. 23, 2015

(86) PCT No.: PCT/SG2015/050230
§ 371 (c)(1),
(2) Date: Jan. 23, 2017

(87) PCT Pub. No.: WO2016/013983
PCT Pub. Date: Jan. 28, 2016

(65) Prior Publication Data

US 2017/0212541 A1 Jul. 27, 2017

Related U.S. Application Data

(60) Provisional application No. 62/027,868, filed on Jul. 23, 2014.

(51) Int. Cl.
*G05F 1/10* (2006.01)
*G05F 3/02* (2006.01)
(Continued)

(52) U.S. Cl.
CPC ..... *G05F 1/567* (2013.01); *G05F 3/242* (2013.01)

(58) Field of Classification Search
CPC ..... G05F 1/567
(Continued)

(56) References Cited

U.S. PATENT DOCUMENTS 6,771,116 B1 * 8/2004 Wang ..... G05F 3/245 323/312
7,812,663 B2 * 10/2010 Lee ..... G05F 3/30 323/313
(Continued)

FOREIGN PATENT DOCUMENTS

JP 2002-76277 A 3/2002
JP 2002-268761 A 9/2002
(Continued)

OTHER PUBLICATIONS

English translation of Japan document (JP2008204148).*
(Continued)

*Primary Examiner* — Metasebia T Retebo

(57) ABSTRACT

A method for providing a voltage reference at a present operating temperature in a circuit is provided. The circuit comprises a first MOS transistor having a first threshold voltage; and a second MOS transistor having a second threshold voltage different from the first threshold voltage is provided. Temperature insensitivity is obtained by compensating the difference between the first threshold voltage and the second threshold voltage with a parameter representative of the present operating temperature.

21 Claims, 3 Drawing Sheets

(51) Int. Cl.
*G05F 1/567* (2006.01)
*G05F 3/24* (2006.01)

(58) Field of Classification Search
USPC ..... 327/514
See application file for complete search history.

(56) References Cited

U.S. PATENT DOCUMENTS

| | | | | |
|---|---|---|---|---|
| 2003/0197552 | A1* | 10/2003 | Watanabe | G05F 3/245 327/541 |
| 2010/0327842 | A1* | 12/2010 | Seok | G05F 3/242 323/313 |
| 2015/0234401 | A1* | 8/2015 | Porras | G05F 1/468 327/513 |

FOREIGN PATENT DOCUMENTS

| | | | |
|---|---|---|---|
| JP | 2003-283258 | A | 10/2003 |
| JP | 2008-204148 | A | 9/2008 |
| WO | 2016013983 | A1 | 1/2016 |

OTHER PUBLICATIONS

Foreign Communication From a Related Counterpart Application, International Search Report and Written Opinion dated Oct. 6, 2015, International Application No. PCT/SG2015/050230 filed on Jul. 23, 2015.

* cited by examiner

METHOD FOR PROVIDING A VOLTAGE REFERENCE AT A PRESENT OPERATING TEMPERATURE IN A CIRCUIT

CROSS-REFERENCE TO RELATED APPLICATIONS

The present application is a filing under 35 U.S.C. 371 as the National Stage of International Application No. PCT/SG2015/050230, filed Jul. 23, 2015, entitled "A METHOD FOR PROVIDING A VOLTAGE REFERENCE AT A PRESENT OPERATING TEMPERATURE IN A CIRCUIT," which claims the benefit of U.S. Provisional Application No. 62/027,868 filed on Jul. 23, 2014, both of which are incorporated herein by reference in their entirety for all purposes

TECHNICAL FIELD

Embodiments of the present invention relate to a method a voltage reference at a present operating temperature in a circuit. In particular, it relates to providing a voltage reference that is temperature insensitive.

BACKGROUND ART

A voltage reference is an essential building block in analog and mixed-signal Integrated Circuits (ICs), including voltage regulators (for example, Low-Dropout (LDO) voltage regulators and regular voltage regulators), DC-DC converters, data converters, etc. A voltage reference ideally serves to generate an uninterrupted reference voltage that is insensitive to process, supply voltage and temperature (PVT).

Moreover, a voltage reference that is used for space applications should also be insensitive to radiation because the operating environment can be harsh in space. Some of the primary radiation effects that may happen in space include Total Ionizing Dose (TID), Single Event Transient (SET), Single Event Upset (SEU) and Single Event Latchup (SEL). Among these radiation effects, SEL is the most critical effect because it often results in permanent damage to ICs.

Conventionally, parasitic bipolor junction transistors (BJTs) have been used in to provide voltage references. However, such conventional techniques provide ICs that are highly susceptible to SEL. Furthermore, a voltage reference that is obtained using the BJTs manifest as a separate IC, and cannot be integrated with other ICs. This means that such voltage references are inappropriate for a System-on-Chip (SOC) realization. FIG. 1 shows a DC-DC convertor that is obtained by Radiation Hardening By Process (RHBP). This application uses the conventional BJT-based rad-hard voltage reference and manifests as a separate IC from the DC-DC converter.

A need therefore exists to provide a method that provides a voltage reference in a circuit that is independent of temperature and power supply variation. It is against this background that the present invention has been developed.

SUMMARY OF INVENTION

According to a first aspect of the Detailed Description, a method for providing a voltage reference at a present operating temperature in a circuit is provided. The circuit comprises a first MOS transistor having a first threshold voltage; and a second MOS transistor having a second threshold voltage different from the first threshold voltage. Temperature insensitivity is obtained by compensating a difference between the first threshold voltage and the second threshold voltage with a parameter representative of the present operating temperature.

In an embodiment, the step of compensating the difference further comprising connecting a gate of the second MOS transistor to a gate of the first MOS transistor, the second MOS transistor being configured as a diode connected transistor.

In an embodiment, the parameter is the mobility of the first and the second MOS transistors.

In an embodiment, the step of compensating the difference further comprises biasing the first and second MOS transistors in a subthreshold region.

In an embodiment, the parameter is a thermal voltage of one of the first MOS transistor and the second MOS transistor.

Additionally, in accordance with a second aspect of the detailed description, a method for designing a circuit to provide a temperature insensitive voltage reference is provided. The circuit includes a first MOS transistor having a first threshold voltage and a second MOS transistor having a second threshold voltage different from the first threshold voltage is provided. The method comprises the step of compensating first and second MOS transistor voltages to provide the temperature insensitive voltage reference by predetermining a difference between the first threshold voltage and the second threshold voltage in response to a parameter representative of the present operating temperature.

In an embodiment, the method further comprises providing two current sources to the circuit.

In an embodiment, the method further comprises providing an amplifier to the circuit, the amplifier being configured to regulate the two current sources.

In an embodiment, the amplifier is configured to provide negative feedback between a supply voltage and an output of at least one of the two current sources to improve the circuit's immunity to power supply noise.

In an embodiment, the two current sources include MOS transistors.

In an embodiment, the amplifier includes at least one MOS transistor.

In an embodiment, an output of the voltage reference is provided based on:

$$V_{REF} = (V_{th0_N1} - V_{th0_N2}) + (\beta_1 - \beta_2)T + \left(\sqrt{\frac{2I}{\mu_0 T_0^2 C_{ox} A_1}} - \sqrt{\frac{2I}{\mu_0 T_0^2 C_{ox} A_2}}\right)T$$

where $V_{th0}$ is MOS threshold voltage at 0K,

I is the current in the current source, $V_{th0_N1}$ is the threshold voltage of the first transistor at 0K, $V_{th0_N2}$ is the threshold voltage of the second transistor at 0K, $\beta$ is MOS threshold voltage temperature coefficient, $T_0$ is an arbitrary temperature, $\mu_0$ is the carrier mobility at $T=T_0$, $C_{OX}$ is gate oxide capacitance, and A is aspect ratio of MOS transistor wherein the output of the voltage reference is the difference of the first threshold voltage and the second threshold voltage.

In an embodiment, an output of the voltage reference is provided based on:

$$V_{REF} = (V_{th0_N1} - V_{th0_N2}) + (\beta_1 - \beta_2)T + \left(\frac{mk}{q}\ln\frac{A_{N2}I_{0_N2}}{A_{N1}I_{0_N1}}\right)T$$

where m is a subthreshold slope factor, $V_{th0_N1}$ is the threshold voltage of the first transistor at 0K, $V_{th0_N2}$ is the threshold voltage of the second transistor at 0K, k is Boltzmann's constant, q is electrical charge, and $I_0$ ($=\mu_0 T_0^2 C_{ox}(m-1)k^2/q^2$) is a temperature independent current.

In an embodiment, the method further comprises connecting a source of the second MOS transistor to a resistor.

In an embodiment, the method further comprises providing an output of the circuit from the source of the second MOS transistor.

In an embodiment, the method further comprises adjusting a width to length ratio of the one of the current sources to trim a magnitude of one of the current sources, wherein the adjustment includes (i) connecting one or more of the first MOS transistor or the second MOS transistor or (ii) disconnecting the first MOS transistor or the second MOS transistor in parallel to the one of the current sources.

In an embodiment, the method further comprises inserting one or more cascade transistor stages between (i) the first MOS transistor and the second MOS transistor and (ii) the current source to accommodate a higher supply voltage to the circuit.

In an embodiment, the method further comprises adjusting a value of the resistor to adjust an output voltage of the circuit.

In an embodiment, the resistor comprises a plurality of series connected resistors, the method further comprising selecting a node within the plurality of connected resistors to obtain the output voltage of the circuit.

In an embodiment, the method further comprises radiation hardening the circuit.

BRIEF DESCRIPTION OF DRAWINGS

The accompanying figures, where like reference numerals refer to identical or functionally similar elements throughout the separate views and which together with the detailed description below are incorporated in and form part of the specification, serve to illustrate various embodiments and to explain various principles and advantages in accordance with a present embodiment.

DESCRIPTION OF EMBODIMENTS

The following detailed description is merely exemplary in nature and is not intended to limit the invention or the application and uses of the invention. Furthermore, there is no intention to be bound by any theory presented in the preceding background of the invention or the following detailed description.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive. It should further be appreciated that the exemplary embodiments are only examples, and are not intended to limit the scope, applicability, operation, or configuration of the invention in any way. Rather, the foregoing detailed description will provide those skilled in the art with a convenient road map for implementing an exemplary embodiment of the invention, it being understood that various changes may be made in the function and arrangement of elements and method of operation described in an exemplary embodiment without departing from the scope of the invention as set forth in the appended claims.

Various embodiments of this invention relate to methods for providing a voltage reference at a present operating temperature in a circuit. Also, various embodiments relate to methods for designing a circuit for providing a temperature insensitive voltage reference.

A person skilled in the art will understand that voltage references generally refer to electronic circuits that ideally produce a fixed (constant) voltage irrespective of the loading on the device or power supply variations. Voltage references are used in power supplies, analog-to-digital converters, digital-to-analog converters, and other measurement and control systems. Voltage references vary widely in performance; a regulator for a computer power supply may only hold its value to within a few percent of the nominal value, whereas laboratory voltage standards have precisions and stability measured in parts per million. In other words, the operating principle of voltage reference circuit is to generate a voltage independent of temperature and power supply variations. Voltage reference circuits are widely used to ensure the biasing of both digital and analog blocks. For applications in space, it is also important for the voltage reference circuits to be insensitive to radiation.

Figure 1:
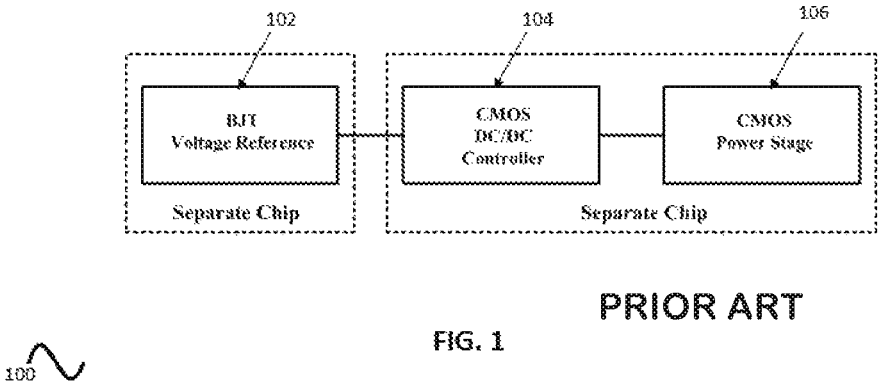
FIG. 1 depicts a schematic block diagram of a radiation-hardened DC-DC converter comprising a conventional radiation-hardened voltage reference circuit.

With reference to FIG. 1, a schematic block diagram of a radiation-hardened (rad-hard) DC-DC converter 100 comprising a conventional rad-hard voltage reference circuit 102 is shown. The conventional voltage reference circuit 102 is built using parasitic Bipolar Junction Transistors (BJTs). However, as mentioned in the foregoing, one of the shortcomings of parasitic BJTs is that they are highly prone to SEL effect. In order to design a rad-hard voltage reference, the Radiation Hardening By Process (RHBP) approach is usually adopted. The intrinsically rad-hard fabrication processes make use of native BJTs that are adopted for the voltage reference design. Consequently, the rad-hard voltage reference 102 which is designed based on the rad-hard fabrication processes manifests as a separate IC, and hence cannot be integrated with other ICs (for example, a CMOS DC/DC controller 104 and a CMOS power stage 106). This makes a conventional rad-hard voltage reference to be inappropriate for System-on-Chip (SoC) realizations. The rad-hard voltage reference and the DC/DC converter which manifest as two separate ICs result in potentially poor reliability, higher cost and larger form factor.

Figure 2:
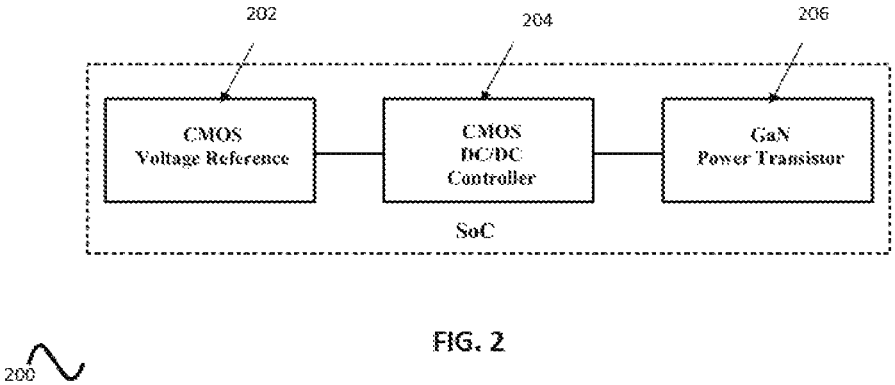
FIG. 2 depicts a schematic block diagram of a radiation-hardened DC-DC converter comprising a radiation-hardened voltage reference circuit according to an embodiment of the invention.

With reference to FIG. 2, a schematic block diagram of a radiation-hardened DC-DC converter 200 comprising a rad-hard voltage reference circuit 202 according to an embodiment of the invention is shown. The rad-hard voltage reference circuit 202 is achieved by means of the Radiation Hardened By Design (RHBD) approach and is integrated with a CMOS DC/DC controller 204 and a CMOS power stage 206 as one single chip. In one embodiment, the radiation hardiness of the DC-DC converter can be further enhanced by adopting intrinsically rad-hard III-V semiconductors (for example, Gallium Nitride (GaN) transistors) in its power stage (instead of the CMOS output stage 206 shown in FIG. 2). A specific implementation further comprises radiation hardening the circuit.

Figure 3:
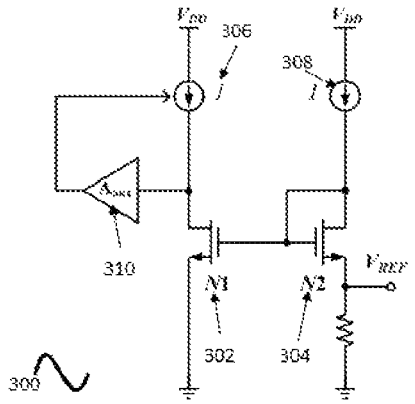
FIG. 3 depicts a circuit diagram of an exemplary circuit providing the radiation-hardened voltage reference circuit shown in FIG. 2.

FIG. 3 depicts a circuit diagram of an exemplary circuit 300 providing the rad-hard voltage reference circuit shown FIG. 2. In an embodiment of the invention, the circuit 300 comprises a first MOS transistor 302 and a second MOS transistor 304. The first MOS transistor 302 comprises a first threshold voltage and the second MOS transistor 304 comprises a second threshold voltage which is different from the first threshold voltage. In accordance with one embodiment, a difference between the first threshold voltage and the second threshold voltage is compensated with a parameter representative of a present operating temperature so as to obtain a voltage reference having temperature insensitivity at present operating temperature.

In an embodiment, a method for designing a circuit to provide a temperature insensitive voltage reference is provided. The method comprises the step of compensating the first and second MOS threshold voltages to provide the temperature insensitive voltage reference by predetermining a difference between the first threshold voltage and the second threshold voltage in response to a parameter representative of the present operating temperature.

In the embodiment, the second MOS transistor 304 is configured as a diode connected transistor and has a gate that is connected to a gate of the first MOS transistor. Additionally or alternatively, a source of the second MOS transistor 304 is connected to a resistor. In an embodiment, the output of the circuit 300 is the source of the second MOS transistor. Advantageously, this feature offers driving capability. In the embodiment, an output voltage of the circuit 300 may be adjusted by means of a value of a resistor. The resistor may comprise a plurality of series connected resistors and the output voltage of the circuit is obtained by selecting a node from the plurality of resistors.

The circuit may also comprise two other current sources 306 and 308. In an embodiment, the two other current sources 306 and 308 are MOS transistors. Additionally or alternatively, a magnitude of one of the current sources 306 or 308 is trimmed by means of adjusting a width to length ratio of the one of the current sources 306 and 308. The adjustment is done by either connecting or disconnecting the first and second transistors 302 and 304 in parallel to said one of the current sources 306 and 308. In order to get a higher supply voltage to the circuit 300, one or more cascade transistor stages may be inserted between the two MOS transistors 302, 304 and the current source 306 or 308. Advantageously, this allows the specific implementations to be trimmed to achieve a desired performance. Further advantageously, this allows the specific implementations to have multiple outputs.

Referring to FIG. 3, the circuit 300 further comprises an amplifier 310. The amplifier 310 may be provided by a MOS transistor. In an embodiment, the amplifier 310 is configured to regulate at least one of the two current sources 302 and 304. Additionally or alternatively, the amplifier 310 is configured to regulate the two current sources 302 and 304. The amplifier 310 is configured to provide negative feedback between a supply voltage and the output of at least one of the two current sources 302 and 304, improving the circuit's immunity to power supply noise.

The circuit 300 may be provided in two embodiments namely subthreshold and suprathreshold. In any one of the two embodiments, the circuit may be radiation-hardened. The table below provides a table detailing the conditions for the two embodiments:

| MOS Bias Condition | Definition |
|---|---|
| Subthreshold | $V_{gs} < V_t$ |
| Suprathreshold | $V_{gs} > V_t$ |

where $V_{gs}$ is a voltage between the gate and source of MOS transistors $V_t$ is a threshold voltage of the MOS transistors.

In the suprathreshold embodiment, the MOS transistors 302 and 304 are biased in a suprathreshold region. In other words, the MOS transistors 302 and 304 are biased in a region where the voltage between the gates and the sources of the MOS transistors 302 and 304 is higher than the threshold voltage of the MOS transistors 302 and 304. In the suprathreshold region, temperature insensitivity of the voltage reference circuit 300 is obtained by compensating the difference between the first threshold voltage and the second threshold voltage with a parameter representative of a present operating temperature, wherein the parameter is the mobility of the first MOS transistor 302 and the second MOS transistor 304.

The output of the voltage reference circuit 300 is the difference of the first threshold voltage of the first MOS transistor 302 and the second threshold voltage of the second MOS transistor 304. The output of the voltage reference circuit 300 is based on:

$$V_{REF} = (V_{th0_N1} - V_{th0_N2}) + (\beta_1 - \beta_2)T + \left(\sqrt{\frac{2I}{\mu_0 T_0^2 C_{OX} A_1}} \sqrt{\frac{2I}{\mu_0 T_0^2 C_{OX} A_2}}\right)T \quad (1)$$

where $V_{th0}$ is MOS threshold voltage at 0K,

I is the current in the current source, $V_{th0_N1}$ is the threshold voltage of the first transistor at 0K, $V_{th0_N2}$ is the threshold voltage of the second transistor at 0K, β is MOS threshold voltage temperature coefficient, $T_0$ is an arbitrary temperature, $\mu_0$ is the carrier mobility at $T=T_0$.

$C_{OX}$ is gate oxide capacitance, and

A is aspect ratio of MOS transistor

The first term, $V_{th0_N1}$, in equation 1 is temperature independent. The second term, $V_{th0_N2}$, is negatively proportional to T as $\beta_1<\beta_2$ in this example. The third term $\beta_1$, is designed to be positively proportional to T. In an embodiment, the second term, $V_{th0_N2}$, and the third term, $\beta_1$, compensate each other by means of adjusting $A_{N1}$ and $A_{N2}$. In other words, the pertinent parameters available to optimize temperature coefficient in this embodiment are $A_{N1}$ and $A_{N2}$.

Figure 4:
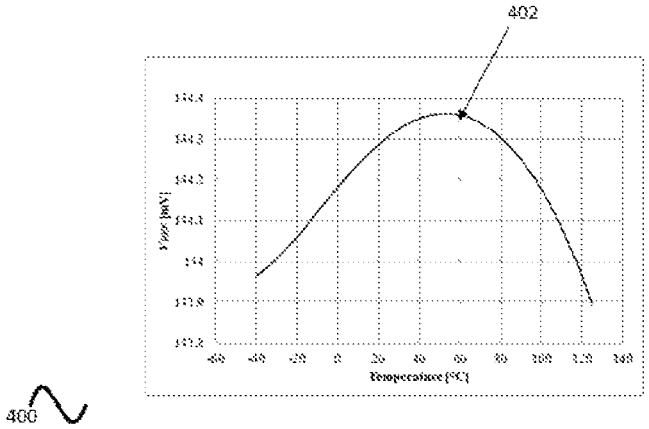
FIG. 4 depicts a graphical diagram illustrating a voltage of an exemplary radiation-hardened voltage reference over a temperature range of 40° C. to 125° C. when the MOS transistors are biased in a suprathreshold region.

FIG. 4 depicts a graphical diagram 400 illustrating a voltage 402 of an exemplary radiation-hardened voltage reference ($V_{REF}$) over a temperature range of 40° C. to 125° C. when the MOS transistors are biased in a suprathreshold region. $V_{REF}$ is at approximately 144 mV at −40° C. and approximately 144.4 at 125° C. In other words, $V_{REF}$ varies by only 0.5 mV within −40° C. to 125° C., hence exhibiting a low TC of only 14 ppm/° C. Advantageously, the SEL effect is also largely mitigated in the suprathreshold embodiment since a conventional parasitic BIT is not used. Furthermore, since the MOS transistors 302 and 304 are biased in the suprathreshold region, the TID effect is also minimized.

In the subthreshold embodiment, the MOS transistors 302 and 304 are biased in a subthreshold region. In other words, the MOS transistors 302 and 304 are biased in a region where the voltage between the gates and the sources of the MOS transistors 302 and 304 is lower than the threshold voltage of the MOS transistors 302 and 304. In the subthreshold region, temperature insensitivity of the voltage reference circuit 300 is obtained by compensating the difference between the first threshold voltage and the second threshold voltage with a parameter representative of a present operating temperature, wherein the parameter is a thermal voltage of the first MOS transistor 302 or a thermal voltage of the second MOS transistor 304.

In the subthreshold region, the first threshold voltage and the second threshold voltage are used to compensate a parameter representative of the temperature based on:

$$V_{REF} = (V_{th0_N1} - V_{th0_N2}) + (\beta_1 - \beta_2)T + \left(\frac{mk}{q}\ln\frac{A_{N2}I_{0_N2}}{A_{N1}I_{0_N1}}\right)T \quad (2)$$

where m is a subthreshold slope factor, $V_{th0_N1}$ is the threshold voltage of the first transistor at 0K, $V_{th0_N2}$ is the threshold voltage of the second transistor at 0K, k is Boltzmann's constant, q is electrical charge, and $I_0$ ($=\mu_0 T_0^2 C_{ox}(m-1)k^2/q^2$) is a temperature independent current.

The first term, $V_{th0_N1}$, and the second term, $V_{th0_N2}$, in equation (2) are temperature independent and negatively proportional to temperature, T. The third term, $\beta_1$, is designed to be positively proportional to T by properly selecting $A_{N1}$ and $A_{N2}$, and compensates of the second term, $V_{th0_N2}$.

Figure 5:
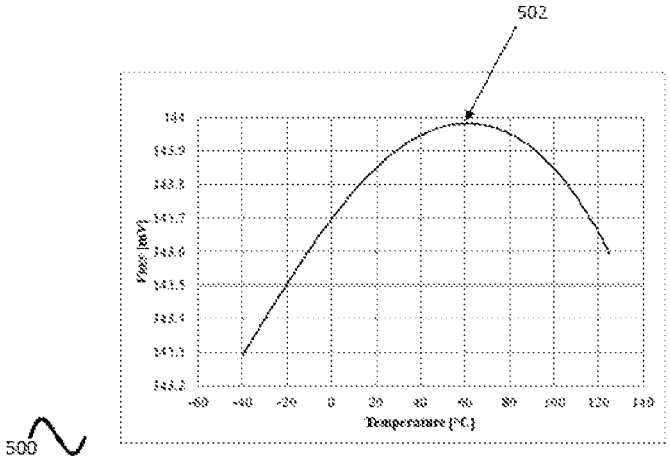
FIG. 5 depicts a graphical diagram illustrating a voltage of an exemplary radiation-hardened voltage reference over a temperature range of 40° C. to 125° C. when the MOS transistors are biased in a subthreshold region.

FIG. 5 depicts a graphical diagram 500 illustrating a voltage 502 of an exemplary radiation-hardened voltage reference ($V_{REF}$) over a temperature range of −40° C. to 125° C. when the MOS transistors are biased in a subthreshold region. $V_{REF}$ is at approximately 143.3 mV at −40° C. and reaches its peak at approximately 144 at 60° C. In other words, $V_{REF}$ varies by only 0.7 mV within −40° C. to 125° C., hence exhibiting a low TC of only 20 ppm/° C. Advantageously, the circuit in the subthreshold embodiment is low-power (several nWs) and low-voltage (~0.5V) because of the nature of subthreshold biased MOS transistors. The low voltage and low power features render this embodiment highly appropriate for power critical space applications, particularly for the emerging nano and pico satellite industry where satellites of low mass and size are used. A miniaturized satellite is typically under 500 kg which means that they require smaller and more compact ICs. Further advantageously, SEL immunity for this low-power and low-voltage full-MOS voltage reference circuit is also obtained by the elimination of parasitic BJTs.

It is clear to a person skilled in the art that CMOS transistor may be used in any of the embodiments described in the foregoing. The circuit described in the foregoing may be implemented using a 65 nanometers CMOS technology. The operating principle is to provide a voltage reference that is independent of temperature and power supply variations. A rad-hard voltage reference obtained by the foregoing circuits is also insensitive to radiation, rendering it highly appropriate for critical space applications.

It should further be appreciated that the exemplary embodiments are only examples, and are not intended to limit the scope, applicability, operation, or configuration of the invention in any way. Rather, the foregoing detailed description will provide those skilled in the art with a convenient road map for implementing an exemplary embodiment of the invention, it being understood that various changes may be made in the function and arrangement of elements and method of operation described in an exemplary embodiment without departing from the scope of the invention as set forth in the appended claims.

The invention claimed is:

1. A method for providing a temperature insensitive voltage reference at a present operating temperature in a radiation hardened circuit comprising a first MOS transistor having a first threshold voltage and a second MOS transistor having a second threshold voltage different from the first threshold voltage, the method comprising:

compensating a difference between the first threshold voltage and the second threshold voltage with a parameter representative of the present operating temperature to obtain temperature insensitivity, wherein the first MOS transistor and the second MOS transistor are arranged in a parallel configuration in which a gate of the first MOS transistor is connected to a gate of the second MOS transistor and the temperature insensitive voltage reference is provided at a source of the second MOS transistor and an output of the temperature insensitive voltage reference is provided based on:

$$V_{REF} = (V_{th0_N1} - V_{th0_N2}) + (\beta_1 - \beta_2)T + \left(\sqrt{\frac{2I}{\mu_0 T_0^2 C_{ox} A_1}} - \sqrt{\frac{2I}{\mu_0 T_0^2 C_{ox} A_2}}\right)T$$

where $V_{th0}$ is MOS threshold voltage at 0 K,

I is the current in the current source, $V_{th0_N1}$ is the threshold voltage of the first transistor at 0 K, $V_{th0_N2}$ is the threshold voltage of the second transistor at 0 K, $\beta$ is MOS threshold voltage temperature coefficient, $T_0$ is an arbitrary temperature, $\mu_0$ is the carrier mobility at $T=T_0$, $C_{OX}$ is gate oxide capacitance, and A is aspect ratio of MOS transistor, wherein the output of the voltage reference is the difference of the first threshold voltage and the second threshold voltage.

2. The method according to claim 1, wherein the step of compensating the difference further comprising connecting the second MOS transistor as a diode connected transistor.

3. The method according to claim 1, wherein the step of compensating the difference further comprising biasing the first and second MOS transistors in a suprathreshold region.

4. The method according to claim 3, wherein the parameter is the mobility of the first and the second MOS transistors.

5. The method according to claim 1, wherein the step of compensating the difference further comprising biasing the first and second MOS transistors in a subthreshold region.

6. The method according to claim 5, wherein the parameter is a thermal voltage of one of the first MOS transistor and the second MOS transistor.

7. The method according to claim 1, wherein the first MOS transistor and the second MOS transistor are arranged in a parallel configuration and wherein the circuit is radiation hardened by biasing the first and second MOS transistors to operate in suprathreshold and/or subthreshold regions.

8. A method for designing a circuit to provide a temperature insensitive voltage reference, the circuit including a first MOS transistor having a first threshold voltage, and a second MOS transistor having a second threshold voltage different from the first threshold voltage, the first MOS transistor and the second MOS transistor being arranged in a parallel structure, the method comprising:

compensating a difference between the first and second threshold voltages with a parameter representative of a present operating temperature to provide the temperature insensitive voltage reference, wherein a gate of the first MOS transistor is connected to a gate of the second MOS transistor and the temperature insensitive voltage reference is provided at a source of the second MOS transistor and an output of the voltage reference is provided based on:

$$V_{REF} = (V_{th0_N1} - V_{th0_N2}) + (\beta_1 - \beta_2)T + \left(\sqrt{\frac{2I}{\mu_0 T_0^2 C_{ox} A_1}} - \sqrt{\frac{2I}{\mu_0 T_0^2 C_{ox} A_2}}\right)T$$

where $V_{th0}$ is MOS threshold voltage at 0 K,

I is the current in the current source, $V_{th0_N1}$ is the threshold voltage of the first transistor at 0 K, $V_{th0_N2}$ is the threshold voltage of the second transistor at 0 K, β is MOS threshold voltage temperature coefficient, $T_0$ is an arbitrary temperature, $\mu_0$ is the carrier mobility at $T=T_0$, $C_{OX}$ is gate oxide capacitance, and A is aspect ratio of MOS transistor, wherein the output of the voltage reference is the difference of the first threshold voltage and the second threshold voltage.

9. The method according to claim 8, further comprising providing two current sources to the circuit.

10. The method according to claim 9, further comprising providing an amplifier to the circuit, the amplifier being configured to regulate the two current sources.

11. The method according to claim 10, wherein the amplifier is configured to provide negative feedback between a supply voltage and an output of at least one of the two current sources to improve the circuit's immunity to power supply noise.

12. The method according to claim 9, wherein the two current sources include MOS transistors.

13. The method according to claim 10, wherein the amplifier includes at least one MOS transistor.

14. The method according claim 8, further comprising connecting a source of the second MOS transistor to a resistor.

15. The method according to claim 9, further adjusting a width to length ratio of the one of the current sources to trim a magnitude of one of the current sources, wherein the adjustment includes (i) connecting one or more of the first MOS transistor or the second MOS transistor or (ii) disconnecting the first MOS transistor or the second MOS transistor in parallel to the one of the current sources.

16. The method according to claim 8, further comprising inserting one or more cascade transistor stages between (i) the first MOS transistor and the second MOS transistor and (ii) the current source to accommodate a higher supply voltage to the circuit.

17. The method according to claim 14, further comprising adjusting a value of the resistor to adjust an output voltage of the circuit.

18. The method according to claim 17, wherein the resistor comprises a plurality of series connected resistors, the method further comprising selecting a node within the plurality of connected resistors to obtain the output voltage of the circuit.

19. The method according to claim 8, further comprising radiation hardening the circuit.

20. A method for providing a temperature insensitive voltage reference at a present operating temperature in a radiation hardened circuit comprising a first MOS transistor having a first threshold voltage and a second MOS transistor having a second threshold voltage different from the first threshold voltage, the method comprising:

compensating a difference between the first threshold voltage and the second threshold voltage with a parameter representative of the present operating temperature to obtain temperature insensitivity, wherein the first MOS transistor and the second MOS transistor are arranged in a parallel configuration in which a gate of the first MOS transistor is connected to a gate of the second MOS transistor and the temperature insensitive voltage reference is provided at a source of the second MOS transistor and an output of the temperature insensitive voltage reference is provided based on:

$$V_{REF} = (V_{th0_N1} - V_{th0_N2}) + (\beta_1 - \beta_2)T + \left(\frac{mk}{q}\ln\frac{A_{N2} I_{0_N2}}{A_{N1} I_{0_N1}}\right)T$$

where m is a subthreshold slope factor, $V_{th0_N1}$ is the threshold voltage of the first transistor at 0K, $V_{th0_N2}$ is the threshold voltage of the second transistor at 0K, k is Boltzmann's constant, q is electrical charge, and $I_0$ ($=\mu_0 T_0^2 C_{ox}((m-1)k^2/q^2)$) is a temperature independent current.

21. A method for designing a circuit to provide a temperature insensitive voltage reference, the circuit including a first MOS transistor having a first threshold voltage, and a second MOS transistor having a second threshold voltage different from the first threshold voltage, the first MOS transistor and the second MOS transistor being arranged in a parallel structure, the method comprising:

compensating a difference between the first and second threshold voltages with a parameter representative of a present operating temperature to provide the temperature insensitive voltage reference, wherein a gate of the first MOS transistor is connected to a gate of the second MOS transistor and the temperature insensitive voltage reference is provided at a source of the second MOS transistor, and an output of the voltage reference is provided based on:

$$V_{REF} = (V_{th0_N1} - V_{th0_N2}) + (\beta_1 - \beta_2)T + \left(\frac{mk}{q}\ln\frac{A_{N2}I_{0_N2}}{A_{N1}I_{0_N1}}\right)T$$

where m is a subthreshold slope factor, $V_{th0_N1}$ is the threshold voltage of the first transistor at 0K, $V_{th0_N2}$ is the threshold voltage of the second transistor at 0K, k is Boltzmann's constant, q is electrical charge, and $I_0$ ($=\mu_0 T_0^2 C_{ox}((m-1)k^2/q^2)$) is a temperature independent current.

* * * * *